US005514303A

United States Patent [19]

Chiu et al.

[11] Patent Number: 5,514,303

[45] Date of Patent: May 7, 1996

[54] HUMIDIFIER WITH REMOVABLE SUCTION TUBE

[75] Inventors: Bernard Chiu, Wellesley; John Longan, Natick, both of Mass.; Robert L. Marvin, Jr., Farmington, Conn.

[73] Assignee: Duracraft Corporation, Southborough, Mass.

[21] Appl. No.: 373,335

[22] Filed: Jan. 17, 1995

[51] Int. Cl.[6] ..... B01F 3/04

[52] U.S. Cl. ..... 261/91

[58] Field of Search ..... 261/91

[56] References Cited

U.S. PATENT DOCUMENTS

| | | | |
|---|---|---|---|
| 3,321,196 | 5/1967 | Weatherston et al. | 261/91 |
| 3,342,466 | 9/1967 | Flury | 261/91 |
| 3,348,821 | 10/1967 | Martin et al. | 261/91 |
| 3,605,385 | 9/1971 | Stoop | 261/91 |
| 4,749,389 | 6/1988 | Worag | 261/91 |
| 5,215,685 | 6/1993 | Marino | 261/91 |

FOREIGN PATENT DOCUMENTS

| | | | |
|---|---|---|---|
| 2170119 | 7/1986 | United Kingdom | 261/91 |

*Primary Examiner*—Tim R. Miles

*Attorney, Agent, or Firm*—John E. Toupal; Harold G. Jarcho

[57] ABSTRACT

A humidifier having a reservoir, an exhaust opening, and a humidification unit including a motor driven fan with a suction tube attached thereto, a diffusion screen, and an intake opening. Water is drawn from the reservoir through the suction tube and dispersed towards the diffusion screen to cause mist which is combined with air drawn through the intake opening by the fan and expelled through the exhaust opening. An integral latch mechanism removably and replaceably attaches the suction tube to the fan to facilitate cleaning of the tube.

22 Claims, 6 Drawing Sheets

HUMIDIFIER WITH REMOVABLE SUCTION TUBE

BACKGROUND OF THE INVENTION

The present invention relates generally to portable electrical humidifiers, and more specifically to those known as impeller or "cool mist" type humidifiers, which employ a fan blade, a spinning suction tube, and a diffuser screen. Mist is created mechanically through collision of water dispersed by the spinning tube against the diffuser screen and is exhausted after mixing with air by the fan blade.

Impeller humidifiers have been known for many years and it is common to employ therewith a suction tube which is attached directly at its top end to the fan blade which also serves as a cover. Since the tube is generally a hollow cone with its apex pointing downwardly into a water filled reservoir and having only one small intake hole and no more than a few exhaust holes, it is practical to manufacture the tube with an open ended top and to cover the open end with the fan blade. Mating of the tube to the fan blade must be substantially sealed to avoid unintended dispersal of water at that junction. Accordingly, the tube generally is glued, welded, or screwed to the fan blade.

The drawing of water upward into the tube against gravity requires that the cross sectional area of the intake opening be minimized. Thus, the intake opening typically is only large enough to allow an adequate water flow for an acceptable humidification rate. However, the intake cannot be so small as to become easily blocked by particles or the build-up of impurities from the water and generally is on the order of 0.060" to 0.187" in diameter.

The exhaust openings adjacent to the upper end of the tube should also be small tangentially to avoid structural weakening of the tube. Usually the tube protrudes precariously from the humidification head when removed from the reservoir and its long thin profile renders it easily broken if not adequately strong. The exhaust openings should also be small enough in the vertical direction to ensure that water sprayed therefrom can be properly directed toward the diffuser screen. If the spray is too wide and a portion is thereby aimed away from the screen, it will not collide with the screen to become mist but will instead return to the reservoir, resulting in inadequate humidification efficiency. Exhaust openings are generally in the order of 0.060" wide vertically and 0.060" to 0.50" wide tangentially.

The reservoirs of these humidifiers are most often filled with water taken directly from a tap. Such water is often laden with impurities and minerals. Also, when water is left unused in the reservoir for an extended period, microbial growth may occur. These impurities and growth become a problem for the operation of the humidifier when they are drawn into and block the intake opening or when they build-up or grow within the suction tube, impeding the tube's ability to draw water to the exhaust openings. It is therefore critical for effective longterm performance that the intake opening hole and inner surface of the suction tube be cleaned regularly.

Present impeller humidifiers have several drawbacks which prevent simple and safe cleaning of the tubes. First, if the tube is permanently attached to the fan blade, rinsing the tube under running water risks the possibility of dangerously wetting the electrical components within the humidification unit. Second, because the intake and exhaust openings are so small, it is difficult to impossible to access the inner surfaces of the tube in order to perform an adequate cleaning. In those humidifiers having the tube attached to the fan blade by screws, a screwdriver is required to disassemble the tube from the fan blade and access those inner surfaces. As a result of these difficulties, it is often the case that the cleaning required for proper longterm performance is compromised or neglected. To alleviate these problems, one prior impeller humidifier employs a collar that detachably secures a tube to a fan blade. However, the collar increases cost and complicates cleaning. In addition, removal of the tube and collar undesirably exposes electrical portions of the humidification unit.

It is the object of the present invention therefore, to provide a humidifier with a suction tube that is easily removed and cleaned.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
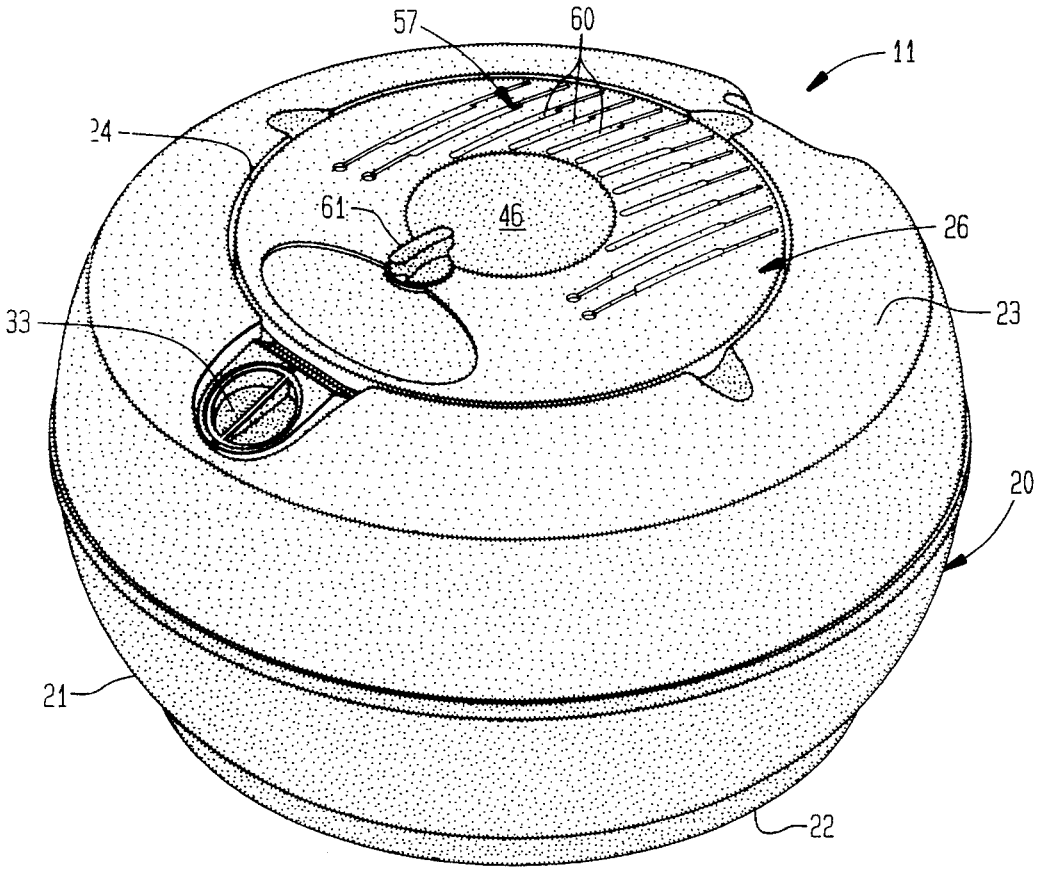
FIG. 1 is a perspective view of a humidifier in accordance with the present invention.
Figure 2:
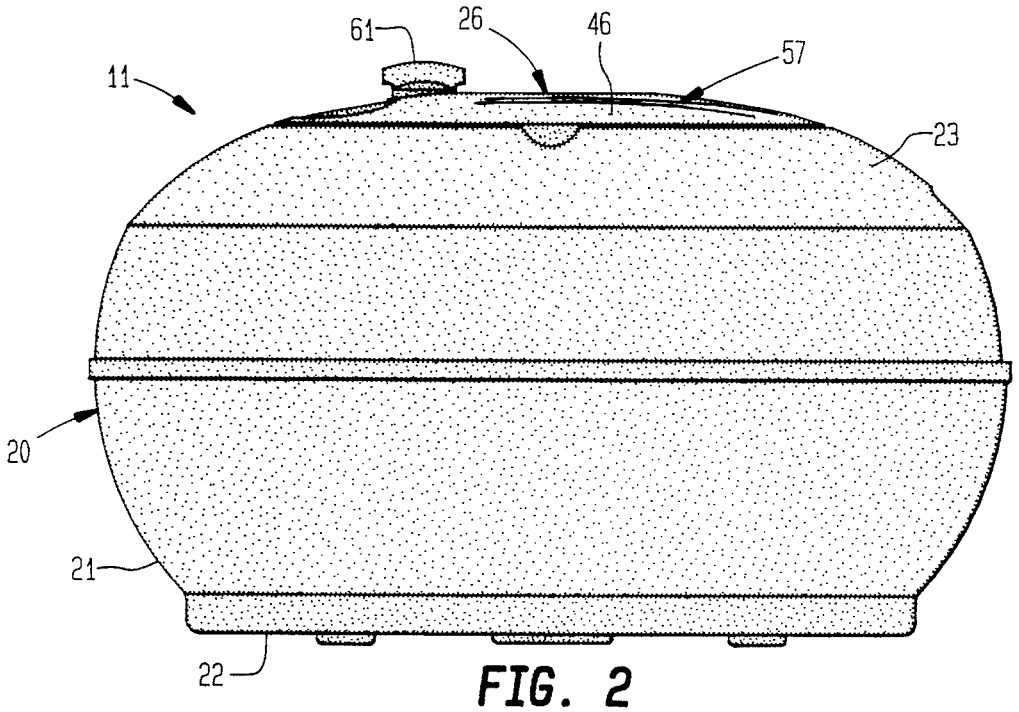
FIG. 2 is a side view of the humidifier of FIG. 1.
Figure 3:
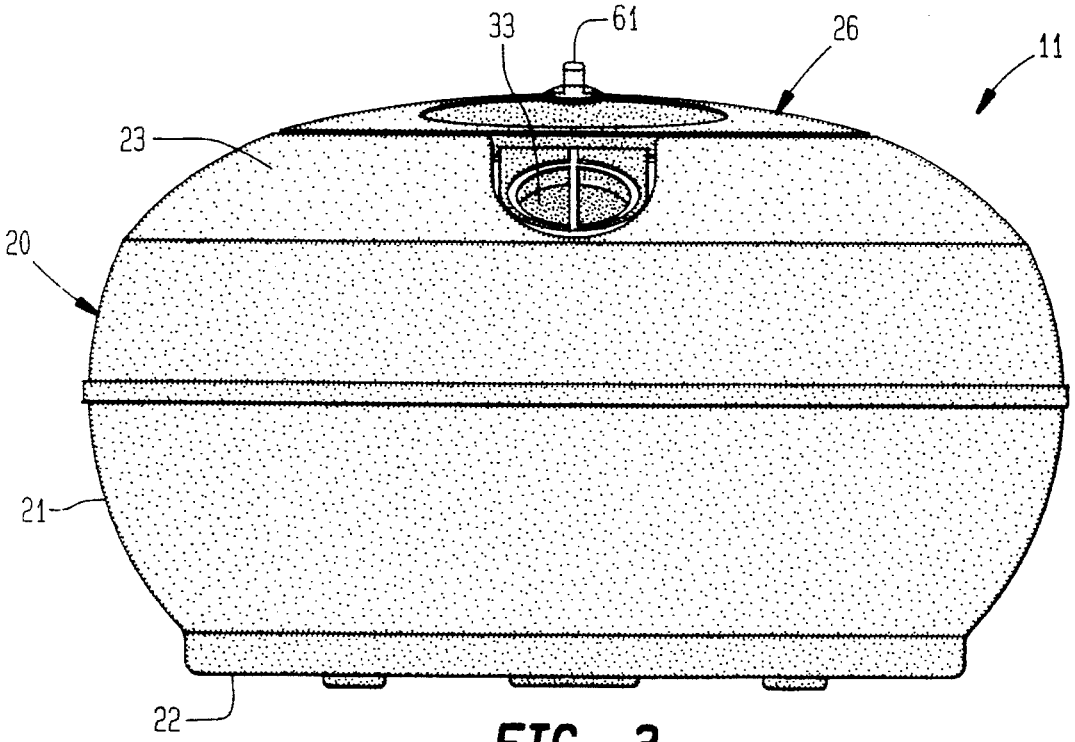
FIG. 3 is a front view of the humidifier of FIG. 1.
Figure 4:
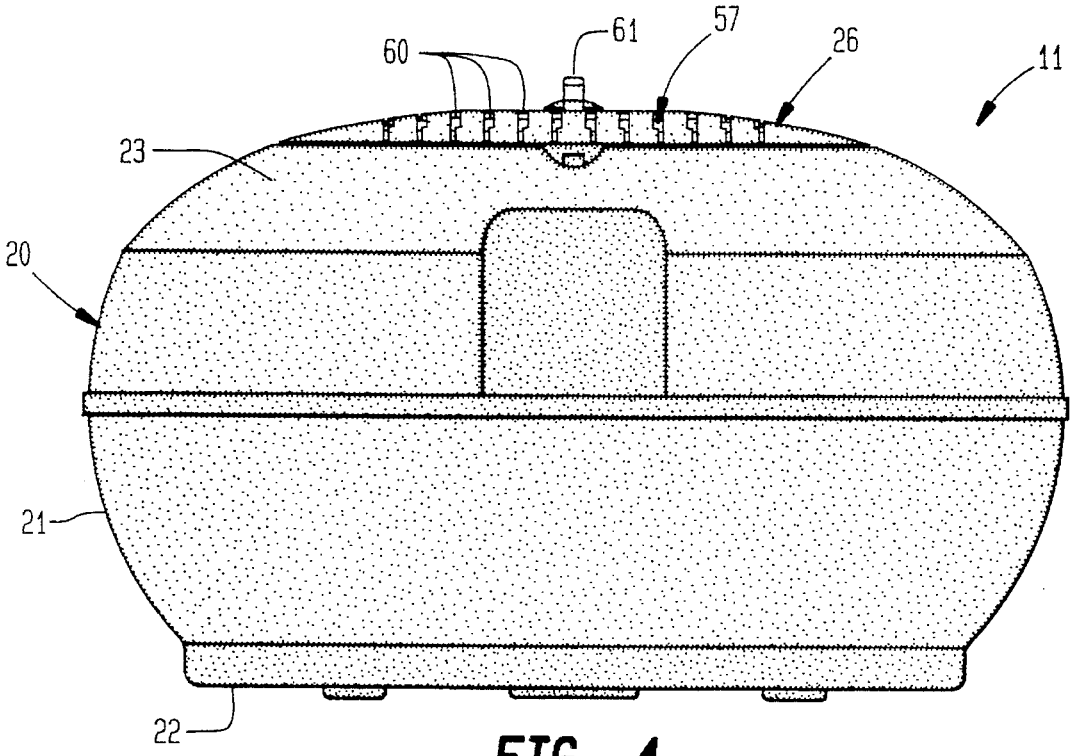
FIG. 4 is a back view of the humidifier of FIG. 1.
Figure 5:
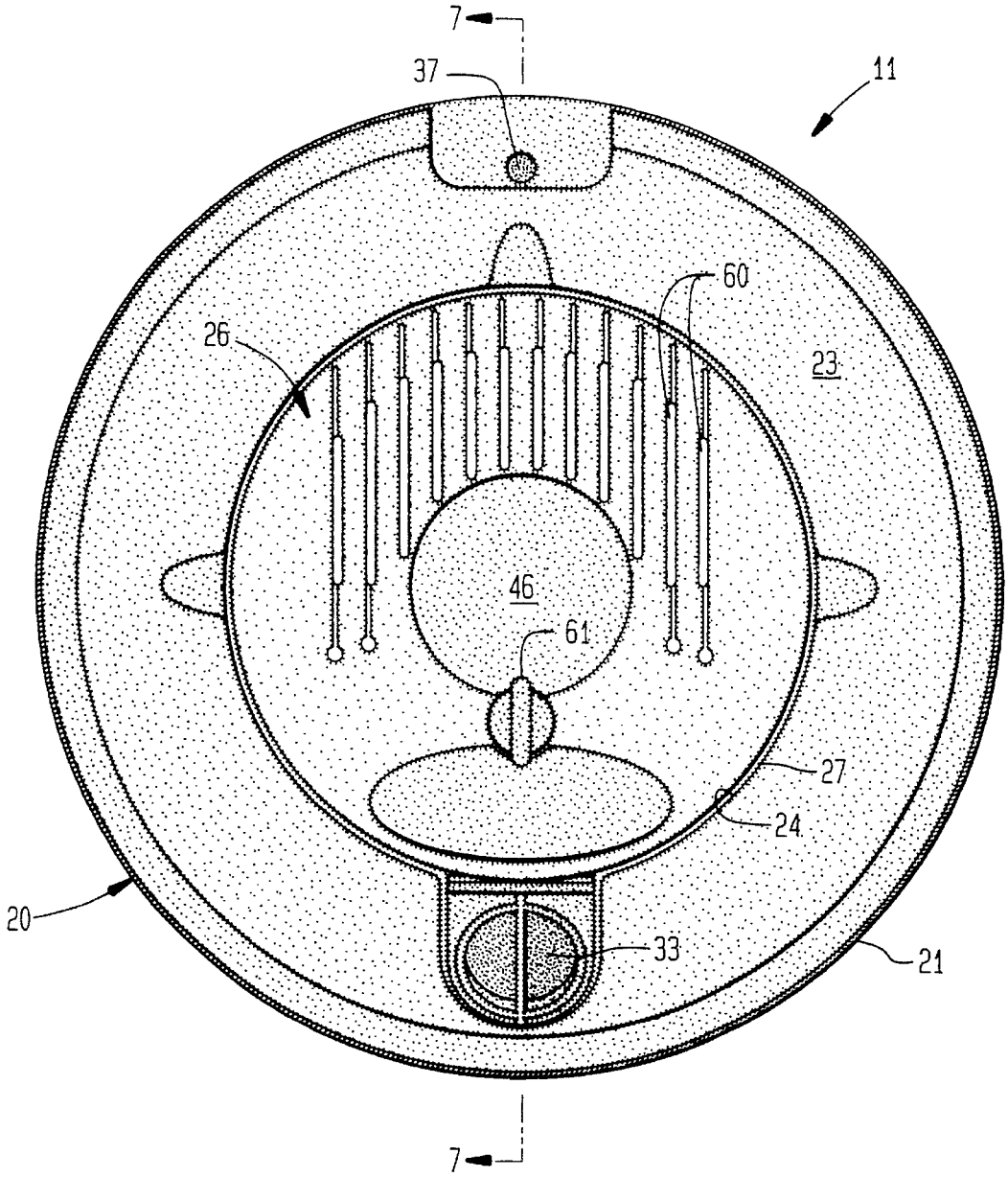
FIG. 5 is a top view of the humidifier of FIG. 1.
Figure 6:
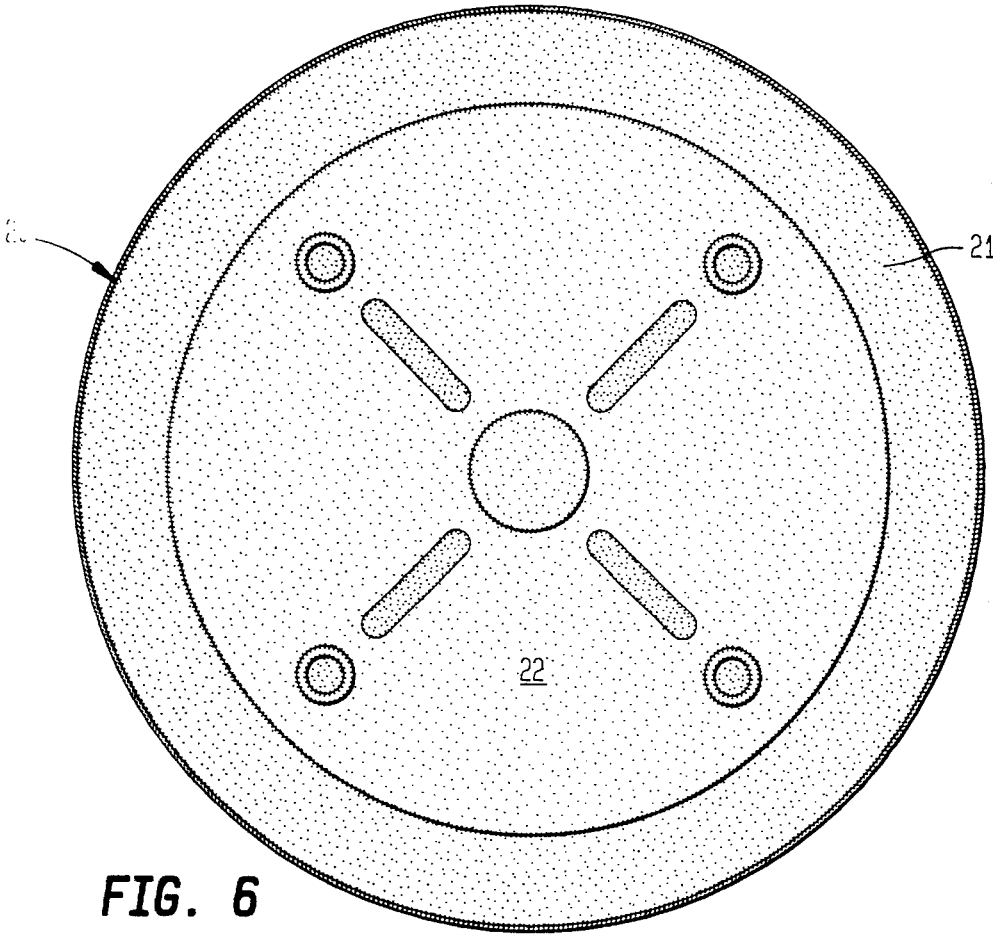
FIG. 6 is a bottom view of the humidifier of FIG. 1.
Figure 7:
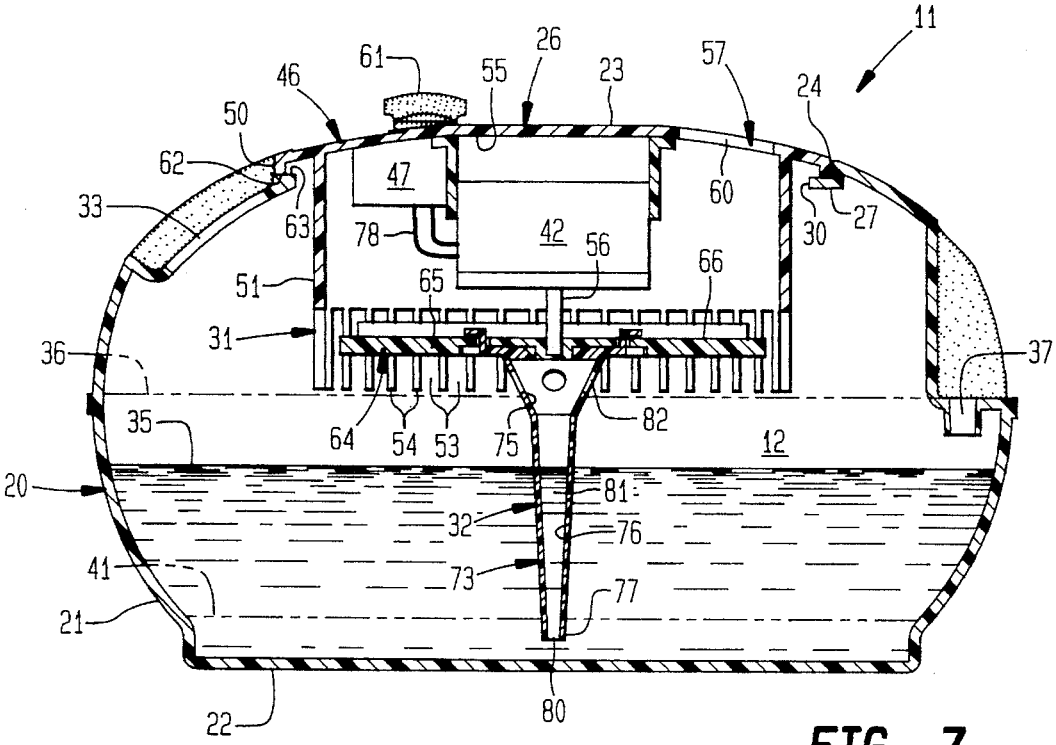
FIG. 7 is a sectional view taken on plane A—A of FIG. 5.

A portable humidifier 11 includes a housing 20 that defines a reservoir 12 shown in FIG. 7. The housing 20 is a blow-molded polypropylene tank 21 having a continuous wall thickness of approximately 0.060". As shown, the tank 21 is basically spherical in shape, truncated and closed at a bottom wall 22 to provide a stable base and truncated and open at a top portion 23. An opening 24 in the top portion 23 receives a humidification unit 26 that is supported by a continuous annular shelf 27. A smaller opening 30, concentric with the larger opening 24 provides access into the reservoir 12 for a diffuser screen 31 and suction tube 32 of the humidification unit 26. The opening 30 also functions as a water filling hole for the tank 21. An opening 33 in the upper surface of the housing 20 serves as an exhaust opening through which mist and air are exhausted from the humidifier 11. Overfilling of the reservoir 12 is prevented by an orifice 37 formed in the top portion 23 at a maximum desired water level 36.

The humidification unit 26 includes a partially spherical injection molded plastic cover 46 which also serves as a mounting plate for the motor 42 and a switch 47. Integrally molded and depending from the cover 46 are an outer cylindrical ring 50 and an inner cylindrical housing 51. A lower end of the inner cylindrical housing 51 forms a cylindrical diffuser screen 31 comprised of a continuous series of slots 53 approximately 0.060" wide adjacent solid separators 54 approximately 0.060" wide. The motor 42 is mounted by screws (not shown) on an underside 55 of the cover 46 and has a shaft 56 directed downwardly therefrom. Sharing a common axis are the outer cylindrical ring 50, the inner cylindrical housing 51, and the motor shaft 56.

The cover 46 defines an air intake vent 57 consisting of a series of elongated slots 60. Mounted to the cover 46 by screws (not shown) is the control switch 47 whose shaft (not shown) extends upwardly through a hole (not shown) in the cover 46 and is attached to a switch knob 61. The cylindrical outer ring 50 is slightly smaller in diameter than the large hole 29 at the top of the tank 21 to allow for proper radial positioning of the humidification unit 26. When the humidification unit 26 is lowered onto the reservoir 12, a bottom edge 62 of the outer ring 50 contacts an upper surface 63 of the annular shelf 27 to properly position the humidification unit 26 vertically.

Attached to the motor shaft 56 by pressure-fit is an injection molded plastic fan blade 64 consisting of a flat circular disk 65 having a series of radially positioned ridges 66 extending upwardly therefrom. An outer edge 70 of the blade 64 is vertically aligned with and radially spaced from the diffuser screen 31 by approximately 0.125" to 0.25". The combination of the disk 65, the inner cylindrical housing 51, and the cover 46 form an enclosure for the motor 42, switch 47 and electrical wiring 78 therefore. When the blade 64 is rotated by the motor 42, the upwardly extending ridges 66 expel air in a tangential direction through centrifugal force toward the diffuser screen 31. As air is expelled from the blade 64, it is thereby also drawn through the intake openings 57 of the cover 46. The only escape for air drawn into the humidifier 11 is out the exhaust opening 33.

Engaged to the bottom side of the flat disk 65 of the fan blade 64 is the injection molded plastic suction tube 32. As shown in FIG. 7, the tube 32 consists of an inverted hollow cone 73 defining a conically shaped cavity 81 and having an open top end 74, a first conical portion 75 of approximately sixty inclusive angular degrees, a second conical portion 76 of approximately five inclusive angular degrees, and a truncated apex 77 at its lower tip. The apex 77 of the cone 73 is located below the operating water level in the reservoir 12 and defines a suction intake hole 80 axially positioned at the lowest tip of the tube 32 to allow water to enter the hollow cavity 81. Energization of the motor 42 results in spinning of the suction tube 32 which draws water in an upward and outward direction by centrifugal force until it reaches a pair of water outlet holes 82 axially spaced one hundred and eighty angular degrees and closely adjacent to the top of the tube 52.

Water that rises within the tube 32 but does not immediately escape through the outlet holes 82 will collect against the fan blade 64 and will be redirected towards and eventually through the outlet holes 82. As the water is dispersed through the outlet holes 82 it sprays against the diffuser screen 31 where it is broken up into a mist. Larger droplets of the mist and water which collects on any other surfaces within the humidifier 11 fall back into the reservoir 12 and will again be drawn into the suction tube 32. Finger droplets of the mist remain airborne and are easily carried by the airflow of the fan through the exhaust opening 33 and out into the environment.

Figure 8:
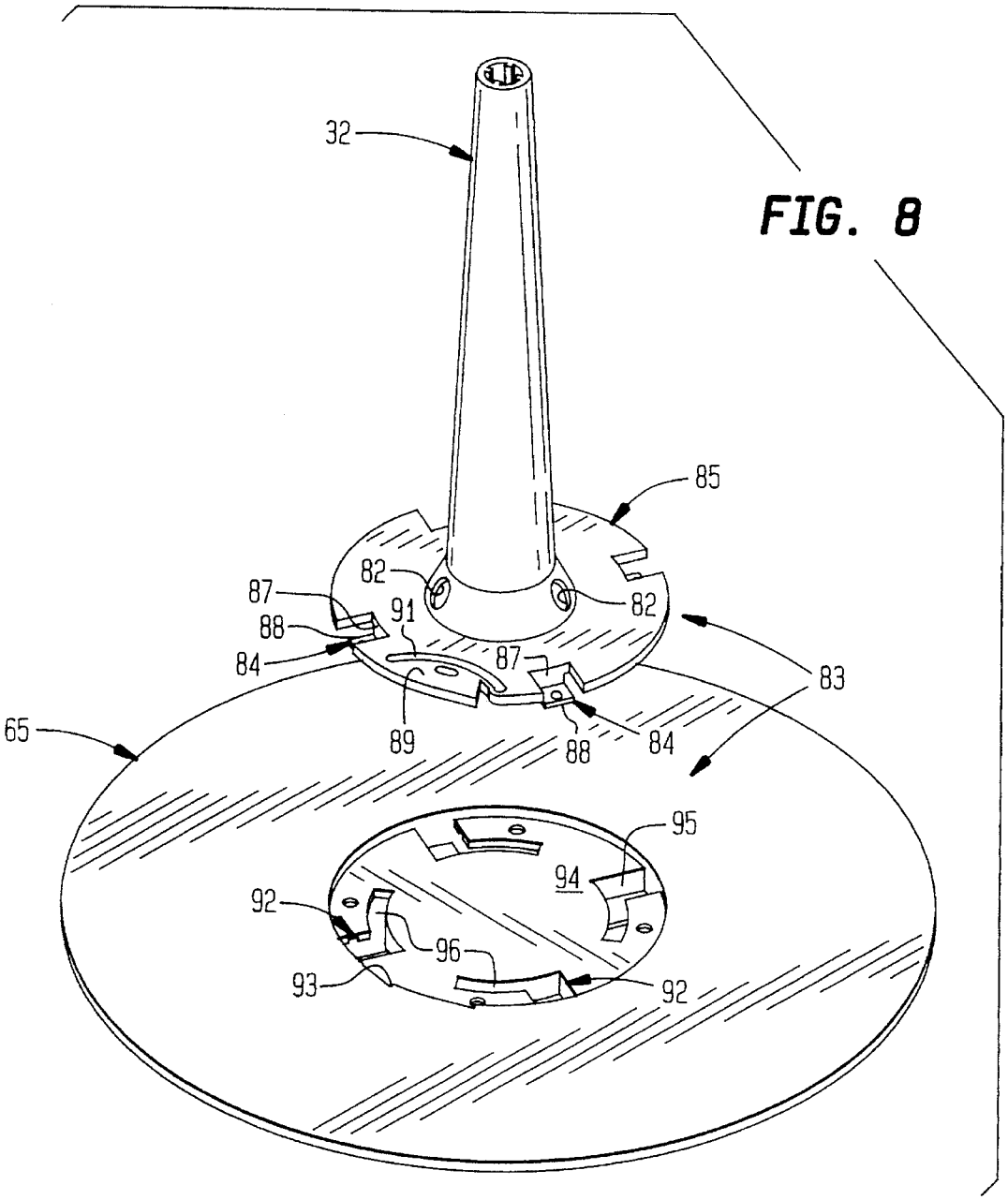
FIG. 8 is a perspective view of the humidifier of FIG. 1 with a suction tube and fan blade disengaged; and the humidifier of FIG. 1 showing the engagement features.
Figure 9:
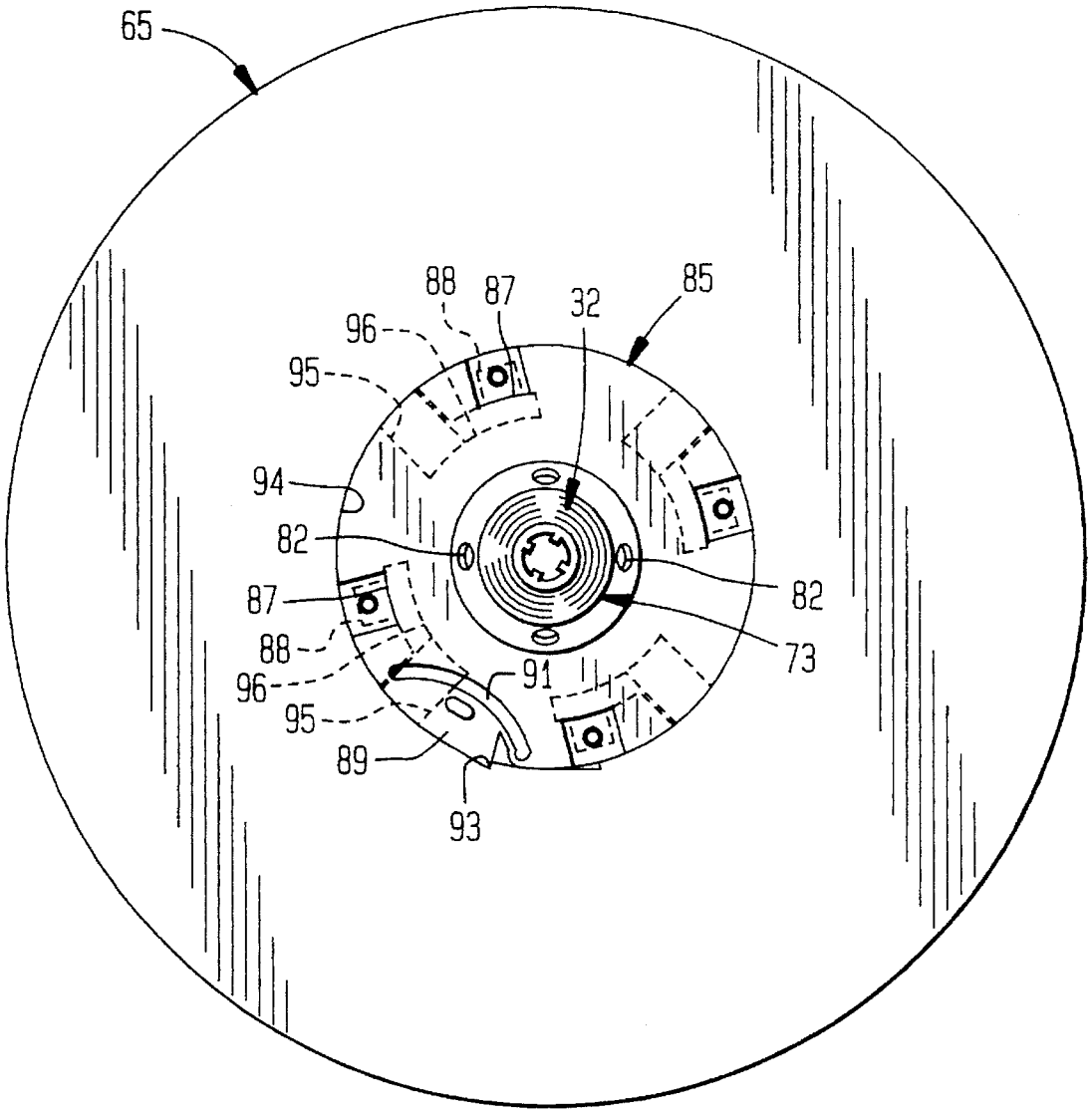
FIG. 9 is a plan view of the fan blade and suction tube shown engaged.

Attachment of the suction tube 32 to the fan blade 64 is accomplished by a latch mechanism 83 shown in FIGS. 8 and 9. The latch mechanism 83 includes a plurality of circumferentially spaced apart finger members 84 formed on an outer periphery of an annular flange 85 extending transversely and outwardly from the open end 74 of the tube 32. Each of the finger members 84 has a longitudinally projecting portion 87 joined to a radially projecting portion 88. Also included in the latch mechanism 83 is a flexible tab 89 formed at the outer periphery of the flange 85 by an arcuate opening 91.

Other portions of the latch mechanism 83 are a plurality of circumferentially spaced apart slots 92 and a notch 93 formed on an outer periphery of a circular recess 94 in a central portion of the fan blade 65. Each of the slots 92 has an outwardly projecting outer portion 95 and a circumferentially directed inner portion 96 intersecting an outer portion 95. Preferably, both the tube 32 and the fan blade 65 are molded as integrally formed units.

In response to aligned relative axial movement between the fan blade 65 and tube 32, each of the finger members 84 enters an outer portion 95 of one of the slots 92. Subsequent relative rotation between the fan blade and tube 32 moves each longitudinally projecting portion 87 of a finger member 84 into an inner portion 96 of a slot 92 and moves each radially projecting portion 88 into a latched position on a side of the fan blade 65 opposite to the tube 32 as shown in FIG. 9. Engagement between the radially projecting portions 88 and the blade prevents axial separation thereof from the tube 32. In addition, relative rotary latching movement between the blade 65 and tube 32, moves the flexible tab 89 into latching engagement with the notch 93. Accordingly, relative rotational movement between the blade 65 and tube 32 is prevented. When disengagement is desired between the blade 65 and tube 32, the tab 89 is forced inwardly out of the notch 93 and subsequent counterclockwise relative rotation between the blade 65 and tube 32 moves the radially projecting portions 88 of the finger members 84 back into the outer portions 95 of the slots 92. The tube 32 then can be axially separated from the fan blade 65.

With the suction tube 32 removed from the fan blade 64, cleaning of the cavity 81, the suction opening 77 and the discharge openings 82 is easily accomplished by injecting tap water through the open end 74. However, even with the tube 32 removed, the disc 65 continues to shield the motor 42, switch 47 and wiring 78 within the housing 51. Thus, undesirable contact with the electrical components of the humidifier is avoided.

Obviously, many modifications and variations of the present invention are possible in light of the above teachings. It is to be understood, therefore, that the invention can be practiced otherwise than as specifically described.

What is claimed is:

1. A humidifier comprising:

a housing defining a reservoir for retaining a given maximum level of water, an air intake opening, and an exhaust opening;

fan means supported by said housing and having a fan blade arranged to draw air through said intake opening and thereby create a positive pressure in said housing above said water in said reservoir; and humidification means for converting water in said reservoir into mist which is forced by said positive pressure through said exhaust opening, said humidification means comprising a tube defining a conically shaped cavity, an open lower suction end projecting into said reservoir, an open top end substantially larger than said suction end, and a plurality of radially projecting holes disposed closely adjacent to said open top end and communicating with said cavity; and latch means detachably securing said open top end directly to said fan blade.

2. A humidifier according to claim 1 wherein said humidification means further comprises a cylindrical diffusion screen disposed to receive water discharged through said radially projecting holes.

3. A humidifier according to claim 1 wherein said open top end is closed by said fan blade.

4. A humidifier according to claim 1 wherein said fan blade defines a centrally located recess facing said open end and said latch means comprises a plurality of spaced apart finger members surrounding said open top end and each having a longitudinally projecting portion and a radially projecting portion, and a plurality of slots formed in an outer periphery of said recess and each arranged to receive a different one of said finger members, each said slot having an outwardly projecting outer portion and circumferentially directed inner portion intersecting an inner end of said outer portion, and wherein in response to relative axial movement between said top end of said fan blade each of said finger members enter one of said outer portions and in response to relative rotational movement between said top end and said fan blade each of said longitudinally projecting portions enters one of said inner portions and each of said radially projecting portions moves into a latched position on a side of said fan blade opposite to a side thereof facing said open end.

5. A humidifier according to claim 4 wherein said latch means further comprises an annular flange projecting radially outwardly from said open end and receivable by said recess, and said finger members are formed on an outer periphery of said flange.

6. A humidifier according to claim 5 wherein said latch means further comprises a flexible tab on said outer periphery of said flange, and a notch in said outer periphery of said recess; and wherein with said radially projecting portions in said latch position said flexible tab enters said notch to prevent relative rotation between said flange and said fan blade, said flexible tab being manually movable radially inwardly out of said notch to allow said relative rotation.

7. A humidifier according to claim 6 including a rotary drive coupling between said fan blade and said tube.

8. A humidifier according to claim 7 wherein said drive coupling comprises a driving gear disposed centrally in said recess, and teeth formed on said tube and engageable with said gear.

9. A humidifier according to claim 8 wherein said fan blade and said tube each are integrally formed units.

10. A humidifier according to claim 4 wherein said open top end is closed by said fan blade.

11. A humidifier according to claim 10 wherein said latch means further comprises an annular flange projecting radially outwardly from said open end and receivable by said recess, and said finger members are formed on an outer periphery of said flange.

12. A humidifier according to claim 11 wherein said latch means further comprises a flexible tab on said outer periphery of said flange, and a notch in said outer periphery of said recess; and wherein with said radially projecting portions in said latch position said flexible tab enters said notch to prevent relative rotation between said flange and said fan blade, said flexible tab being manually movable radially inwardly out of said notch to allow said relative rotation.

13. A humidifier according to claim 12 including a rotary drive coupling between said fan blade and said tube.

14. A humidifier according to claim 13 wherein said drive coupling comprises a driving gear disposed centrally in said recess, and teeth formed on said tube and engageable with said gear.

15. A humidifier according to claim 14 wherein said fan blade and said tube each are integrally formed units.

16. A humidifier according to claim 15 wherein said humidification means further comprises a cylindrical diffusion screen disposed to receive water discharged through said radially projecting holes.

17. A humidifier according to claim 4 wherein said tube is comprised of a molded plastic material and said engagement means are integrally molded therewith.

18. A humidifier according to claim 17 wherein said open top end is closed by said fan blade.

19. A humidifier according to claim 18 wherein said humidification means further comprises a motor operatively coupled to said fan means and separated from said open top by said fan blade.

20. A humidifier according to claim 19 wherein said humidification means further comprises a cylindrical diffusion screen disposed to receive water discharged through said radially projecting holes.

21. A humidifier according to claim 20 wherein each of said one or more spring-arm members are tangentially positioned about said tube such that force applied inwardly toward said tube in an axial direction allows said disengagement.

22. A humidifier according to claim 18 wherein each of said one or more spring-arm members are tangentially positioned about said tube such that force applied inwardly toward said tube in an axial direction allows said disengagement.

* * * * *